US010588819B2

(12) United States Patent
Yli-Kovero

(10) Patent No.: US 10,588,819 B2
(45) Date of Patent: Mar. 17, 2020

(54) AUTOMATIC SELECTION OF SAUNA BATHING MODE AND IDLE MODE OF A FAN STOVE

(71) Applicant: Risto Tapio Yli-Kovero, Hämeenlinna (FI)

(72) Inventor: Risto Tapio Yli-Kovero, Hämeenlinna (FI)

( * ) Notice: Subject to any disclaimer, the term of this patent is extended or adjusted under 35 U.S.C. 154(b) by 0 days.

(21) Appl. No.: 16/303,811

(22) PCT Filed: May 24, 2017

(86) PCT No.: PCT/FI2017/050391
§ 371 (c)(1),
(2) Date: Nov. 21, 2018

(87) PCT Pub. No.: WO2017/203104
PCT Pub. Date: Nov. 30, 2017

(65) Prior Publication Data

US 2019/0336388 A1 Nov. 7, 2019

(30) Foreign Application Priority Data

May 25, 2016 (FI) ..... 20160145

(51) Int. Cl.
*A61H 33/00* (2006.01)
*A61H 33/06* (2006.01)

(52) U.S. Cl.
CPC ..... *A61H 33/005* (2013.01); *A61H 33/063* (2013.01); *A61H 2033/061* (2013.01);
(Continued)

(58) Field of Classification Search
CPC ..... A61H 2033/061; A61H 2201/0228; A61H 2201/5071; A61H 2201/5082; A61H 33/005; A61H 33/063
(Continued)

(56) References Cited

U.S. PATENT DOCUMENTS

2009/0049597 A1* 2/2009 Saitou ..... A61H 33/063 4/524
2009/0056009 A1* 3/2009 Matsubara ..... A61H 33/063 4/524
(Continued)

FOREIGN PATENT DOCUMENTS

CN 204394965 U 6/2015
DE 2160571 B1 4/1973
(Continued)

OTHER PUBLICATIONS

Finland Search Report, Application No. 20160145, dated Nov. 28, 2016, 1 page.
(Continued)

*Primary Examiner* — Huyen D Le
(74) *Attorney, Agent, or Firm* — Ziegler IP Law Group, LLC

(57) ABSTRACT

A method, in which a fan equipped stove of a sauna is controlled automatically between an idle mode and a sauna bathing mode of the heating of the stove based on relative air humidity of the sauna; sound measured from the sauna; a measured load on benches of the sauna; a motion sensing signal measured from the sauna and/or the temperature of the stove. A controller, a stove and a sauna using the method are also described.

17 Claims, 1 Drawing Sheet

(52) U.S. Cl.
CPC ..... *A61H 2201/0228* (2013.01); *A61H 2201/5064* (2013.01); *A61H 2201/5071* (2013.01); *A61H 2201/5082* (2013.01)

(58) Field of Classification Search
USPC ..... 4/524
See application file for complete search history.

(56) References Cited

U.S. PATENT DOCUMENTS

| | | | | |
|---|---|---|---|---|
| 2010/0024118 | A1* | 2/2010 | Hayasi | A61H 33/06 4/524 |
| 2011/0046702 | A1 | 2/2011 | Duncan | |
| 2012/0232467 | A1* | 9/2012 | Nakamura | A61G 10/026 604/24 |
| 2017/0281465 | A1* | 10/2017 | Takao | A61H 33/063 |

FOREIGN PATENT DOCUMENTS

| | | | |
|---|---|---|---|
| DE | 202005000279 | U1 | 5/2005 |
| FI | 74207 | B | 9/1987 |
| FI | 83157 | B | 2/1991 |
| FI | 89328 | B | 6/1993 |
| FI | 108212 | B | 12/2001 |
| FI | 6317 | U1 | 6/2004 |
| JP | 2010-057654 | A | 3/2010 |

OTHER PUBLICATIONS

International Search Report of the International Searching Authority, Application No. PCT/FI2017/050391, dated Oct. 25, 2017, 5 pages.
Written Opinion of the International Searching Authority, Application No. PCT/FI2017/050391, dated Oct. 25, 2017, 7 pages.
Extended European Search Report received for European Patent Application No. EP178022612, dated Mar. 6, 2019, 08 pages.

* cited by examiner

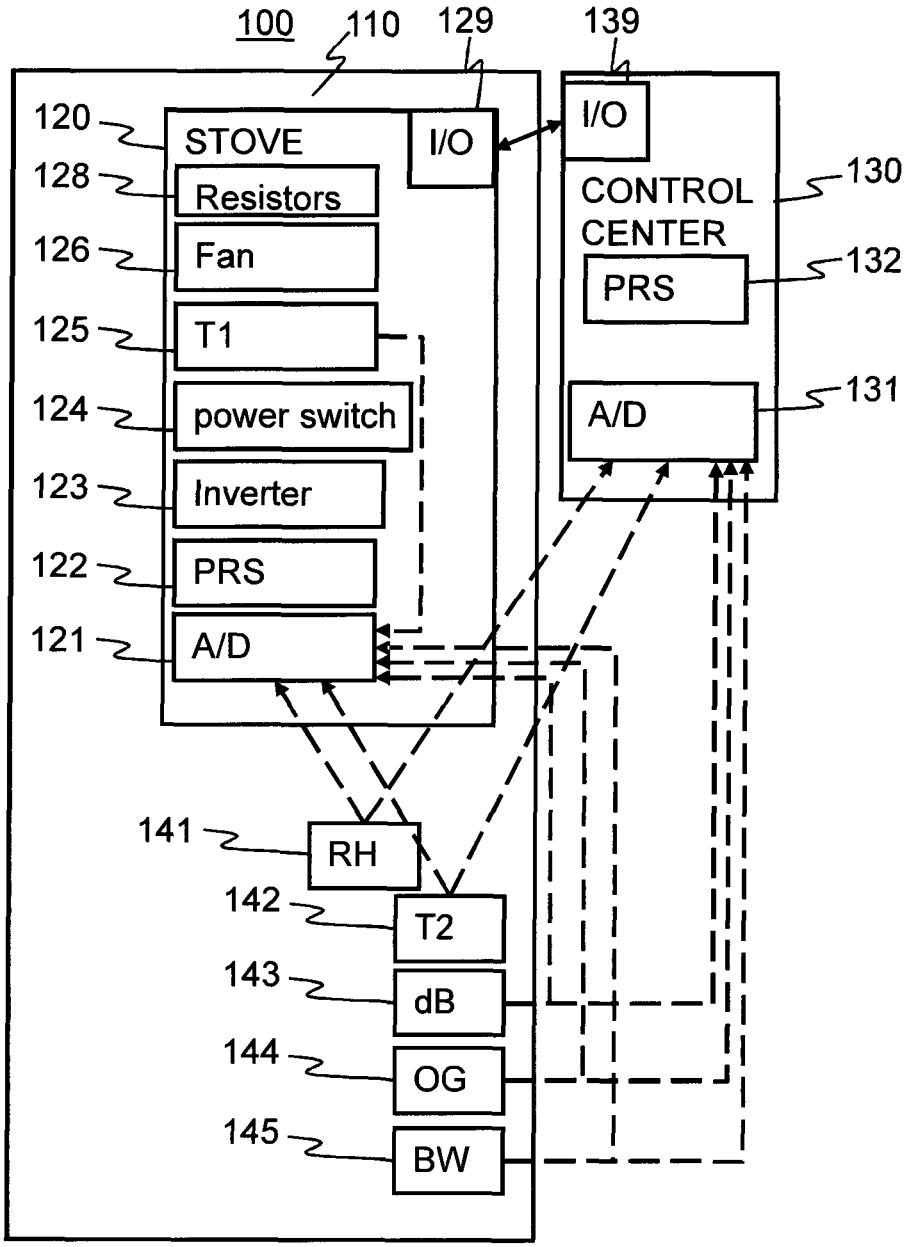
100
110
129
139
120
STOVE
I/O
I/O
128
Resistors
CONTROL
CENTER
130
126
Fan
PRS
132
125
T1
124
power switch
A/D
131
123
Inverter
122
PRS
121
A/D
141
RH
142
T2
143
dB
144
OG
145
BW

AUTOMATIC SELECTION OF SAUNA BATHING MODE AND IDLE MODE OF A FAN STOVE

OBJECT

The aspects of the disclosed embodiments relate to automatic selection of a sauna bathing mode and an idle mode of a fan stove. Particularly, though not exclusively, the invention relates to automatic selection of a sauna bathing mode and an idle mode of a lidless fan stove.

BACKGROUND

The control of a common sauna stove with continuous heating functions based on the temperature of the sauna so that the heating resistors are switched on when the temperature of the sauna is below a set temperature, and the resistors are switched off when the temperature is above the set value.

A sauna stove equipped with a fan and a lid known from publication FI 74207B functions so that in an idle mode when the lid is closed, the control system maintains the temperature of the stones of the stove in accordance with a setpoint. When the lid of the stove is opened, the fan circulates air of the sauna through a stone space of the stove, until the target temperature of the sauna is reached. The temperature of the sauna in the idle mode is typically 40-50 degrees Celsius, from which it increases to the target temperature, for example 80° C.-90° C., in a moment after opening the lid.

In the known sauna stove with a lid, a sauna bathing mode or lid opening command is given to the stove for example with a manual pushbutton, a motion sensor of the lid, or preset timer scheduling.

An aim of the present disclosure is to achieve with a lidless sauna stove nearly the same or corresponding advantages that are achieved with a sauna stove with a lid.

SUMMARY

In accordance with the disclosed embodiments, there is provided a method for controlling a stove of a sauna according to claim 1.

In accordance with the disclosed embodiments, there is provided a stove of a sauna implementing the method according to claim 1.

In accordance with the disclosed embodiments there is provided a controller according to claim 12; a stove of a sauna according to claim 13; and a sauna that is automatically adjusting regarding to heating, according to claim 16. The control device may be implemented using computer program code and/or hardware.

The present disclosure will now be described by way of example with reference to the enclosed drawing.

FIG. 1 presents a block diagram of a system according to an embodiment.

DETAILED DESCRIPTION

FIG. 1 presents a block diagram of a system 100 according to an embodiment of the present disclosure, the system 100 comprising a sauna 110, a stove 120, a controller 130, and sensors 141-145 (an air humidity sensor 141 of the sauna, a stove temperature sensor 142, a sound sensor 143, an optical passage sensor 144, a load sensor 145 of the sauna benches). The stove comprises a first analogue-digital (A/D) transformer 121, a first processor 122, an inverter 123 for controlling the velocity of a fan 126, a power switch 124, such as relays or contacts for each phase, a temperature sensor 125 of the stove, the fan 126, for example under a stone space, and heating resistors 128, or to abbreviate, resistors. The controller 130 comprises a second A/D transformer 131 and a second processor 132. There is a data transfer connection between the first processor 122 and the second processor 131 via respective first and second data transfer means 129, 139 (for example USB, RS-232, CAN channel, Bluetooth, WLAN, powerline communications). There may be a connection from the sensors 141-145 either to the first processor via first 122 or the second processor 132 via respective first or second A/D converter 121, 131. All embodiments do not necessarily comprise all of these parts or may comprise other parts in addition to or instead of these parts, for example in some embodiments the controller 130 is not separate from the stove, but integrated in the stove (and there is only one processor and/or A/D transformer) and/or instead of the inverter 123 of FIG. 1 there may be one or more controllable switches or adjustable current or voltage outlets for switching on/off the fan 126 or to control the velocity. The first A/D transformer 121 and/or the second A/D transformer may be arranged to receive and transform analogue measurement signals to a digital form suitable for digital processing. The first A/D transformer 121 and/or the second A/D transformer may be arranged to digitize analogue signal with a quantization of at least two bits.

The controller 130 may be implemented using computer program code and/or hardware. The controlling system may consist of a controller and sensors or an inlet for receiving signals from one or more sensors 125, 141-145. Optionally, the control system comprises the controller 130, and one or more other parts, such as sensors.

When the sauna 110 is being used, from time to time there is no bather in the sauna, and the sauna may be left to cool in an idle mode to, among other things, save energy and to save structures. In said idle mode, the fan 126 of the stove 120 rotates with a slow velocity, or not at all when the resistors are switched on. When a bather enters the sauna, the stove 120 is brought into a sauna bathing mode, wherein by increasing the power of the fan 126 the temperature of the sauna 110 can be rapidly increased. For example, in the sauna bathing mode the stove 120 or its controller 130 receives an impulse signifying sauna bathing, as a consequence of which the fan 126 is brought to rotate with a speed required for achieving and maintaining the desired sauna bathing temperature.

The stove may be brought into the sauna bathing mode for example as a response to starting throwing water on the stove. To this end, in addition to the temperature sensor 142 of the sauna, the humidity sensor 144 of the sauna and the temperature sensor 125 of the stove may be used.

When water is thrown on the stove 120, the relative humidity of the sauna 110 rises and the stone temperature measured by the temperature sensor 125 of the stove decreases. The controller 130 recognizes from the change in the humidity or in the stone temperature that the sauna bathing has begun, and raises the temperature of the sauna 110 to the sauna bathing temperature by increasing the blow of the fan. Additionally, or optionally, the controller 130 may recognise the sound created by throwing water on the stove for example from detecting that a sound level typical for throwing water on the stove is reached. By humidity measurement, a raise in the air humidity of the sauna caused by water evaporating from the wet skin of bathers that have moved from the shower to the sauna may be detected.

Optionally, a sauna bathing command may be given as a response to one or more of the following:

- receiving signals signifying movement for example from a motion sensor or an optical passage detector installed at the door;
- based on an acoustic detection for example by detecting sounds occurring in the sauna for example with a sensor expressing sound level, such as a decibel meter 143;
- detecting an increase in the load directed to the sauna benches for example by using a strain strip attached to the sauna benches, or another force measurement.

Preferably, the controller 130 maintains the sauna bathing temperature in the sauna bathing mode. From the sauna bathing mode, the controller 130 may switch to the idle mode, when one or more of the following is being realized:

- the relative humidity of the sauna air decreases below a limit value;
- based on the temperature of the stove 120 (for example the temperature of the stone space) there has been a pause of a determined time period in throwing water on the stove;
- the sound measured from the sauna 110 decreases sufficiently, for example the sound measured from the sauna does not meet a certain condition set for continuing the sauna bathing mode (for example sounds exceeding a certain decibel limit have not been detected from the sauna during a certain time period, or the moving average of decibel readouts decreases below a certain limit value);
- the motion recognition signals measured from the sauna 110 do not meet a condition set for sauna bathing (for example the motion recognition signals have not indicated movement in the sauna during a certain time period);
- the load directed to the sauna benches decreases below a certain limit value (for example below the load caused by the normal weight of the sauna benches and a full water bucket);
- the sauna bathing mode has continued continuously for a certain maximum duration.

Sensors 125, 141-145 used for defining the mode of the heating may be placed in a housing protecting the controller 130, or combined to the controller 130 outside of the housing protecting it. The controller 130 may have its own housing, or the controller 130 may be placed in another housing, such as a housing of the stove 120.

More than one sensors 125, 141-145 may be used to distinguish from each other a person entering the sauna 110 and a person leaving the sauna. For example, information about movement happening at the door can be acquired with a motion sensor and whether someone likely entered into the sauna or left the sauna can be concluded from the measured sound level. The sound sensor 143 can measure from the sound the level and/or the spectral distribution of the sound. The sound sensor can be arranged to issue a signal, from which speech cannot be recognized. Optionally, the sound sensor 143 itself may for example be an ordinary microphone, but the signal coming from it may be processed in a way that prevents speech recognition from the sound. The processing of the signal preventing speech recognition can be implemented with analogous components, such as one or more coils or capacitors, or digitally.

The controller 130 monitors preferably the sauna bathing mode based on a combined effect of the temperature and the relative humidity of the sauna 110 so that the change in humidity is proportioned to the temperature of the sauna 110.

The ability of air to absorb water depends strongly on the temperature of the air so that the higher the temperature, the more water is absorbed by the air. Simplified, this is reflected in that in a temperature of 60° C. in a certain conventional sauna a scoopful of water thrown on the stove 120 raises the relative humidity of the sauna 110 twice as much when compared to a temperature of 90° C.

The phenomenon may, simplified and to demonstrate it for the bathers, be called a sauna bathing index, the sauna bathing index being for example the sum of the Celsius degree value of the temperature and the percentage value of the relative humidity of the sauna. When the sum of these is for example 120 intense heat is perceived in the sauna. Said 120 may consist of 60 degrees Celsius and 60 percent, or 100 degrees Celsius+20 percent. The sauna bathing index may also be formed non-linearly for example as an exponential or logarithmic function calculated from the unitless value of the temperature and/or humidity.

In practice, the aforedescribed combined effect of temperature and humidity means that the increase in the relative humidity of the sauna 110 caused by throwing water on the stove may be proportioned to the temperature of the sauna. In an embodiment, the relative humidity and the temperature of the sauna 110 is calculated and shown in the same screen, and their combined effect etc. is presented and calculated with the sauna bathing index, or in a corresponding manner using other temperature and humidity scales. In an embodiment, the sauna bathing index is shown without temperature and/or humidity.

A recording sauna bathing index screen may help to improve the sauna bathing experience. From a sauna bathing index screen according to an embodiment, the bather may see a sauna bathing profile after the sauna bathing has ended, and by changing the temperature settings search for a sauna bathing temperature suitable for himself. With the sauna bathing index, it may be verifiably compared who endures the conditions perceived as the hottest in the sauna, or a possibly harmfully high combination of temperature and humidity may be recognized.

In continuously ready stoves with a lid on the market, a stone thermostat controls the resistors when the lid is closed. Additionally, a sauna thermostat may restrict switching on the resistors when the lid is open. Both controls are switched on at all times without an impulse relating to the start of sauna bathing. The sauna thermostat cannot influence the control of the resistors before the lid has been opened because, when the lid is closed, the stones heat rapidly to the cut-off limit of the stone thermostat. The stone thermostat preventing overheating of the stones, the temperature of the sauna decreases well below the set temperature of the sauna thermostat.

When there are no bathers in the sauna 110, the controller 130 of the stove 120 maintains in an embodiment the temperature of the sauna 120 or the stones by adjusting the blow velocity, typically by bringing the fan 126 to a small velocity or not to blow.

Maintenance of sufficient adjustability of a lidless stove benefits from a fairly large amount of stones. Through a large amount of stones it may be achieved, that the sauna 110 does not overheat even if heat energy sufficient to raise the temperature of the sauna 110 in a moment to the desired level, and to vaporize the water thrown on the stove, is stored inside the stone space.

A typical setting according to an embodiment may be that in the idle mode the sauna 110 is 50-60 degrees and the surface stones are below 100 degrees. Even though the surface stones are not hot, the stones located deeper give enough heat and raise the temperature to the desired level. In said embodiment, the surface stones decrease the sauna warming effect of the radiation heat generated by the stones of the stove.

According to an implementation, the control of the stove starts to speed up the blow of the fan 126 until the temperature of the sauna 110 has risen to the target level, when the stove control 120 receives a sauna bathing impulse, or when the controller 130 determines starting of the sauna bathing mode.

The stove 120 according to the embodiments described in the foregoing may be especially beneficial when the sauna 110 is not entered immediately once the stove 120 is sufficiently warm for sauna bathing. When a conventionally controlled bathing ready sauna waits for bathers for a long time, a situation where the walls are heating and the stones are cooling is approached, because keeping the temperature of the stones of the stove constant decreases the use of the heating resistors in order to avoid overheating of the stones.

The larger the portion of idle time of the time the sauna is switched on, the larger is the amount of waste energy, as well as the wear on the sauna structures. The wood structures of a continuously heating sauna that is continuously switched on dry and splinter, and they have to be changed every couple of years, if the decor of the sauna is to be kept in good shape.

In the embodiments described in the foregoing, a large saving of energy and sauna structures is achieved since the temperature of the sauna 110 is high only a little except for during sauna bathing. Also, the comfort of sauna bathing increases when the sauna benches and walls can cool down between sauna bathing modes towards the temperature of the idle mode.

An opening button and a motion sensor, known starting methods of the sauna bathing mode of a stove with a lid, are not suitable for controlling a lidless stove, because water can be thrown on the lidless stove without opening a lid, and therefore the start of the sauna bathing cannot be concluded from opening a lid.

Compared to an opening button, a motion sensor or to scheduling, the start of the sauna bathing mode based on the start of throwing water on the stove is more inexpensive to implement, since wiring for the push button or motion sensor are not needed. Throwing water on the stove does not require instructions. The duration of the sauna bathing mode is also automatically appropriately adjustable according to the bathers and the maintaining of the sauna bathing mode may end directly once the sauna bathing has ended, or at least without a significant delay. Installing of wires may be avoided by using another sensor installed in the stove or the controlling system, such as a sound level sensor. The sound level sensor need not be positioned in visual connection with the door or sauna benches, and the operation of the sound level sensor is not affected by the proximity of the stove like for example a touch sensor. A sound level sensor is also typically more stable and more reliable than a humidity sensor measuring air humidity.

Measurement of relative humidity may be used also in a stove with a lid, in which the end of sauna bathing may be concluded from the decrease in humidity, and closing the lid. Also in this case, the implementation of the stove may be simplified by leaving out the position detection of the lid. Through measurement of the relative humidity the use of the sauna bathing index in the control of the stove and/or in monitoring the conditions of the sauna may be implemented at the same time.

In idle mode, control based on adjustment of the stone temperature renders to the sauna an uncontrollable temperature that depends of, among other things, the temperature of the stones, isolation of the sauna and ventilation. Because of this, the control of the stove 120 preferably comprises adjustment of the temperature of the idle mode. If, for example, a temperature of the idle mode of 40 degrees would feel like too low, a value of 50° C. may be set for the idle mode, the controller 130 maintaining the value by adjusting the heating of the stove 120 (for example by controlling the fan 126).

For example, with the controller 130 the stove 120 of the sauna 110 is controlled based on the temperature of the stones of the stove 120, and the impulse of the start of the sauna bathing mode is given by throwing water on the stove, due to which the relative humidity of the sauna air rises. The value of the relative humidity giving the sauna bathing impulse is dependent of the temperature of the sauna air. A sauna bathing index is used in the control according to an embodiment, the sauna bathing index being a combination, such as a sum, of the % value of the relative humidity and the Celsius value of the temperature of the sauna. On a screen of the controlling system, for example as a time series, the relative humidity and the temperature and the sauna bathing index may be shown simultaneously.

The afore disclosed description presents some embodiments without intending to limit the present disclosure. Different details of these embodiments may be freely combined or omitted without diverging from the present disclosure, the present disclosure being defined only by the appended claims.

The invention claimed is:

1. A method for controlling a fan equipped stove of a sauna automatically, comprising making a selection between an idle mode and a sauna bathing mode of the heating of the stove based on relative air humidity of the sauna; sound measured from the sauna; a measured load on benches of the sauna; a motion sensing signal measured from the sauna and/or the temperature of the stove.

2. The method according to claim 1, further comprising controlling the stove to heat the sauna more in the sauna bathing mode than in the idle mode by controlling the fan.

3. The method according to claim 1, further comprising selecting as the heating mode of the stove the sauna bathing mode based on sound measured from the sauna.

4. The method according to claim 1, further comprising selecting as the heating mode of the stove the sauna bathing mode based on the sound level measured from the sauna.

5. The method according to claim 1, further comprising selecting as the heating mode of the stove the idle mode based on that the sound measured from the sauna does not meet a certain condition set for continuing the sauna bathing mode.

6. The method according to claim 1, further comprising selecting as the heating mode of the stove the sauna bathing mode based on a rapid increase in the relative air humidity of the sauna or a rapid decrease in the stone temperature of the stove.

7. The method according to claim 1, further comprising controlling in the idle mode heating of the stove based on an idle temperature set for the air of the sauna, the idle temperature being lower than the sauna bathing temperature.

8. The method according to claim 1, further comprising controlling the stove in the sauna bathing mode based on a setpoint of a sauna temperature defined for the air of the sauna.

9. The method according to claim 1, further comprising controlling termination of the sauna bathing mode and shifting to the idle mode based on the relative humidity of the air of the sauna.

10. The method according to claim 1, further comprising controlling the shifting to the sauna bathing mode based on the relative humidity of the air of the sauna and the temperature of the air of the sauna so that the higher the temperature of the air of the sauna is, the lower is the relative air humidity of the sauna signifying start of the sauna bathing mode.

11. The method according to claim 1, further comprising presenting and/or recording as a time series in controlling of the stove a sauna bathing index formed from the temperature and humidity of the air of the sauna, the sauna bathing index describing the combined effect of the temperature and the humidity.

12. A controller for controlling a stove of a sauna, wherein the controller comprises computer program code arranged to implement on the stove the method according to claim 1.

13. A stove of a sauna, wherein the stove comprises a controller according to claim 12.

14. The stove of a sauna according to claim 13, wherein the stove further comprises a fan for adjusting the heating power of the stove.

15. The stove of a sauna according to claim 13, wherein the stove is a lidless stove.

16. A sauna that is automatically adjusting regarding to heating, wherein the sauna comprises:

a stove;

a controller according to claim 12; and one or more sensors to measure relative air humidity of the sauna; sound; a motion sensing signal and/or the temperature of the stove.

17. The sauna according to claim 16, wherein the sauna comprises furnishing or interior surfaces of a material that splinters more the more and the longer the sauna is heated.

* * * * *